United States Patent [19]

Dittmar

[11] 4,030,398

[45] June 21, 1977

[54] ELECTRONIC MUSICAL INSTRUMENT

[75] Inventor: Wilfried Dittmar, Halsenbach, Germany

[73] Assignee: WERSI-electronic GmbH & Co. Kommanditgesellschaft fur elektronische Gerate und elektronische Bauelemente, Halsenbach, Germany

[22] Filed: Mar. 4, 1976

[21] Appl. No.: 663,677

[30] Foreign Application Priority Data

Mar. 6, 1975 Germany ..... 2509684

[52] U.S. Cl. ..... 84/1.26; 84/1.01

[51] Int. Cl.[2] ..... G10H 1/02

[58] Field of Search ..... 84/1.01, 1.26, DIG. 23

[56] References Cited

UNITED STATES PATENTS

| | | | |
|---|---|---|---|
| 2,918,576 | 12/1959 | Munch, Jr. | 84/1.26 |
| 2,953,056 | 9/1960 | Hanert | 84/1.26 |
| 3,003,383 | 10/1961 | Williams | 84/1.26 |

*Primary Examiner*—E. S. Jackmon

*Attorney, Agent, or Firm*—Peter K. Kontler; John Kurucz

[57] ABSTRACT

An improved gate circuit to suppress bounce is provided for an electronic musical instrument such as an electronic organ. The circuit includes a gate having a first input from a constant supply voltage through a key actuated switch, a second input comprising a sound signal and an output connected to one input of combining or summing circuit hereafter called an integrator. A second input to the integrator comprises a constant, compensating voltage comprising a portion of the supply voltage. The output of the integrator is connected to further processing stages of the instrument.

19 Claims, 6 Drawing Figures

ELECTRONIC MUSICAL INSTRUMENT

BACKGROUND OF THE INVENTION

The present invention relates to key-operated, electronic musical instruments and more particularly to an improved gate circuit for use in such instruments.

In key-operated electronic musical instruments (such as electronic organs) it is desirable to reduce the number of mechanical contacts necessary to generate sounds to a minimum, preferably one contact per key. To this end, gate circuits are utilized so that upon the depression of any particular key, an output signal is generated for subsequent processing to develop the desired tone. The output signal appears at the output of a gate the inputs to which are a first, continuous voltage which is present at all the gates and a key-supplied voltage which is applied to the gate in response to the depression of a particular key. The output signal absolute value should correspond to the steady-state (quiescent) condition value of the continuous voltage.

While the above described arrangement is presently utilized, it suffers from a serious drawback. Namely, the tone signal and the key voltage influence each other. That is, the signal voltage that develops in response to the depressions of a key has an average value upon which a sound dependent signal is superimposed. As the amplitude of the one ac- signal increases, the average value of the signal voltage also necessarily increases (to a value above that of the steady-state condition value). This increase is known as "bounce".

Heretofore, various schemes and circuits have been developed to eliminate bounce. In the main, these schemes have sought to increase the common supply voltage to the transistor gates in response to the development of a key-induced voltage in such a way that the average value of the continuous voltage corresponds to the output voltage. To this end, the common supply voltage is provided by a regulator whose input is connected to the top of a voltage divider. The keys (which supply the key voltage) connect suitable resistors in parallel with the elements of the voltage divider to alter the value of the supply voltage. Such circuits are expensive and do not permit all the gates to operate with a uniform supply voltage since it has been found that satisfactory compensation cannot be achieved by this method where different filters are used in the further signal processing stages. In many such electronic organs, the different foot pedals control different filters for subsequent processing. Also, for a particular foot position, in many instances, the gates of neighboring keys are grouped together (e.g., in octaves) and connected to different filters.

In view of the above, it is the principal object of the present invention to provide an improved circuit for the suppression of bounce in a key-operated musical instrument of the type described.

A further object is to provide such an improved circuit wherein all the various gates are driven by a common supply voltage.

SUMMARY OF THE INVENTION

The above and other beneficial objects and advantages are attained in accordance with the present invention by providing an improved circuit to suppress bounce. The circuit includes a gate having a first input from the constant voltage source through a key actuated switch, a second input comprising a sound signal and an output connected to an inverting input of an integrator. A second input to the integrator comprises a constant, compensating voltage derived from the constant voltage source. The output of the integrator is connected to further processing stages of the instrument.

In a preferred embodiment, care is taken to insure that each gate consists of two resistors and a diode having a common connecting point with the resistors. One resistor is connected with the first input of the gate, the diode is connected with the second input of the gate, and the other resistor is connected with the output of the gate. The output of the gate is connected with the first input of the integrator. The first input of each gate is connected with the second input of the integrator by way of a compensating resistor. Therefore, it is only necessary to provide one diode and three resistors for each of the gates.

The construction of the integrator circuit is simplified in that it constitutes a differential amplifier having an inverting input and a non-inverting input.

The differential amplifier may comprise a first transistor whose base and emitter are connected to one input each, possibly through a resistor. The input which is connected to the base is the inverting input and the emitter input is the non-inverting input.

The differential amplifier can further comprise a feedback branch with a second transistor which insures that the voltage at the output is less than the supply voltage, even in the absence of key voltage. This renders it possible to insure, in a very simple manner, that the average value of the constant voltage of the signal which develops in response to depression of keys equals the value of the initial starting voltage.

A highly desirable circuit arrangement consists in that the collector-emitter circuit of the first transistor is in series with a collector resistor and an emitter resistor, that the base of the second transistor is connected with the collector of the first transistor, that the collector of the second transistor is connected with that end of the collector resistor which is remote from the collector of the first transistor, and that the emitter of the second transistor is connected directly with the output and also with that end of the emitter resistor which is remote from the emitter of the first transistor (such connection includes two feedback resistors). The first input of the integrator circuit is connected with the base of the first transistor and to the tap between the two feedback resistors. The second input of the integrator circuit is connected to the emitter of the first transistor. In this circuit arrangement, the second transistor constitutes an emitter-follower. This results in a very low output resistance and hence in a much better separation of sine and square outputs as well as a more satisfactory sine filtering because the cross talk between the signal paths is eliminated due to the low ohmic resistance of the output. Due to the feedback, there is a low input resistance so that the influence of a gate upon the other gates (intermodulations) is negligibly small.

A circuit arrangement which exhibits similar advantages can be obtained if the collector-emitter circuit of the first transistor is connected in series with a two-piece collector resistor and with an emitter resistor, if the base of the second transistor is connected with the collector of the first transistor, if the collector of the second transistor is connected with the tap between the parts of the collector resistor and with the output, and if the emitter of the second transistor is connected with the base of the first transistor and with that end of the emitter resistor which is remote from the emitter of the first transistor (this last mentioned connection includes two feedback resistors). The first input of the integrator circuit is connected with the emitter of the first transistor and the second input of the integrator circuit is connected with the tap between the two feedback resistors.

In accordance with a further embodiment of the invention, an integrator circuit can be used for several gates. The first input of each gate is connected, by way of a compensating resistor, with a compensating conductor which is connected to the second input of the integrator circuit. The compensating conductor is also connected to ground or a source of reference potential, by way of a resistor which is a totalizing resistor. If several gates are actuated simultaneously by key-induced voltage, a higher current flows through the totalizing resistor. Thus, the voltage at the second input of the integrator circuit varies in accordance with the number of actuated gates.

The ouputs of the gates can be connected to a conductor which is connected to the first input of the integrator circuit, and this conductor can be connected with a source of reference potential, through a totalizing resistor. The resistance of the compensating resistors which are associated with the gates can equal that of the resistors which are connected to the outputs of the gates. Therefore, the first input of the integrator circuit receives the sum of sound signals transmitted by the actuated gates. The compensating voltage conforms to such signals.

The resistors which are connected with the outputs of the gates and hence also the compensating resistors can be graduated according to their resistance. This is desirable, for example, for sine wave signal formation at which the higher tones, which are quieter, should be supplied at a higher amplitude than the deeper tones. By utilizing the aforedescribed differential amplifiers, one achieves an additional simplification in that the totalizing resistors can constitute the emitter resistor and one of the feedback resistors.

In a simplest case, a single integrator circuit can be provided for all gates of the organ. This is acceptable for inexpensive organs in which a common filter is used for all foot positions.

In a multi-manual organ, a discrete integrator component can be provided for the gates of each manual. All foot positions of a given manual are then reproduced by way of a common filter. However, the manuals can be registered separately.

In a more sophisticated organ, a discrete integrator component can be provided for the gates of each foot position of each manual. This renders it possible to process each foot position separately. By resorting to suitable filters, one can obtain different sound formations which can then be mixed with each other.

In high-quality organs, a discrete integrator component is provided for the gates of groups of neighboring keys for each foot position of each and every manual. Such circuit renders it possible to achieve separate filtration of all foot positions as well as an optimum formation of sinusoidal signals.

In a versatile organ with the just discussed distribution of integrator components, provision is made to connect the outputs of all integrator components of a foot position with a square wave output through the medium of first decoupling resistors and to connect such outputs with a sine signal output by way of second decoupling resistors and sinusoidal filter stages. The square wave outputs of several foot positions are connected with a sawtooth signal output by way of stepped resistors. In contrast to a passive sound formation separation during application of mechanical key-operated contacts, the low output resistance of integrator components insures a much more satisfactory separation of the three signal forms and higher accuracy of sine formation.

The compensating effect is independent of the intensity of key voltage. The key voltage can be an envelope curve in order to achieve special effects. The compensating voltage assumes different values at the same rate at which a sound signal varies in response to changing key voltage.

With the aforedescribed gated each of which has a diode constituting a gate circuit, one can obtain a switching separation of approximately 60dB (level gate blocked — level gate actuated). If a more pronounced separation is desired, the diode of each gate can be connected in series with at least one second diode. This renders it possible to increase the separation of levels to and in excess of 100dB.

However, it is not necessary to provide a second diode in each of the gates. As a rule, it suffices if a second diode is common to all gates of a given tone and is disposed between the tone generator and the system of cables. This results in substantial savings because an 8-octave generator has only 96 tone frequency outputs whereas a 2-manual organ with 2 × 5 octaves and 9 foot positions each comprises 1098 gates.

The invention will now be described with reference to the drawings which show several embodiments.

DETAILED DESCRIPTION OF THE PREFERRED EMBODIMENT

Figure 1:
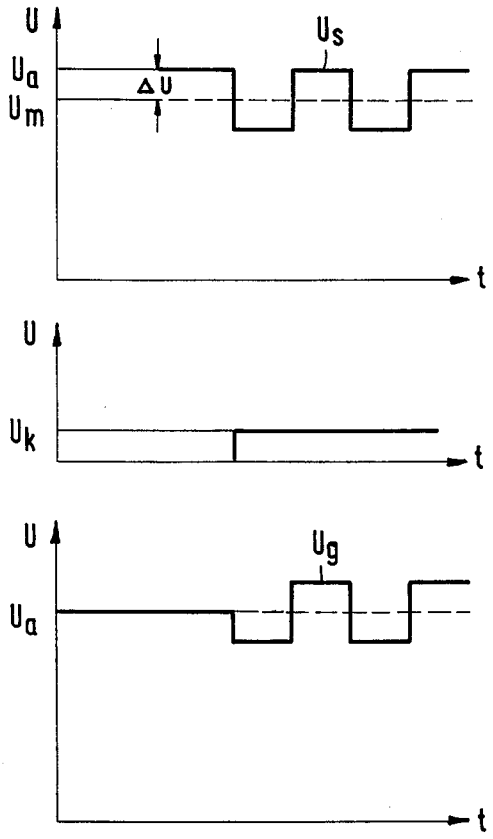
FIG. 1 comprises several voltage-time waveforms depicting the bounce problem and the solution of the present invention.

Reference is first made to FIG. 1 wherein several waveforms depicting the problem sought to be solved by the present invention are depicted. In a conventional gate circuit for an electronic, key-operated musical instrument, a signal voltage $U_s$ is developed at the gate output for subsequent processing. The signal $U_s$ differs only in polarity from a starting voltage $U_a$ which is available in the quiescent condition. The average value of the starting voltage $U_1$ is $U_m$ and this differs from $U_a$ by $\Delta u$ as shown. This jump, $\Delta u$ between the average value of the starting voltage and the signal voltage represents the bounce.

In accordance with the present invention, a compensating voltage, $U_k$ is added to the signal voltage during actuation of the keys. This results in an overall voltage $U_g$, the average value of which is $U_a$.

Figure 2:
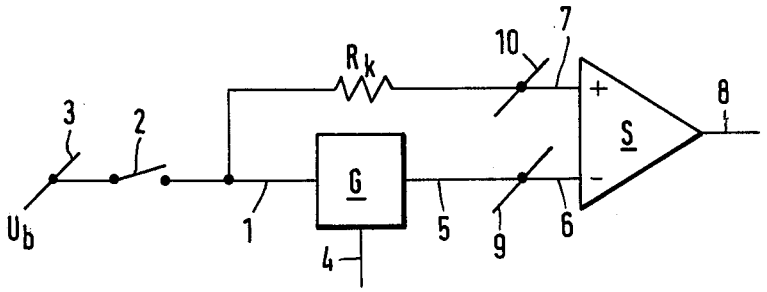
FIG. 2 is a simplified schematic drawing of the present invention.

In FIG. 2 a schematic representation for attaining the above is shown in a simplified form. A gate G has a first input 1 connected to a constant supply voltage $U_b$ through a conductor 3 and a key-operated switch 2. The second input 4 to gate G comprises a tone signal from a tone generator (see TG in FIG. 6). The output 5 of the gate is connected with an inverting input 6 of an integrator S in the form of a differential amplifier. The second input 7 of the integrator is connected to switch 2 through a compensating resistor $R_k$ and is not inverted. The output 8 of the integrator is connected to subsequent processing steps (not shown).

The inverting input 6 is connected (or can be connected) to the output or outputs of additional gates through conductor 9. Similarly, the noninverting input 7 is connected (or can be connected) with the compensating resistors of additional gates through conductor 10.

When switch 2 is closed (i.e., when the proper key of the instrument is depressed), the key voltage $U_b$ is applied to the input 1 of gate G permitting the tone signal $U_s$ to connect with the inverting input 6 of amplifier S. At the same time, the noninverting input 7 to the amplifier S receives the compensating voltage $U_K$ (which is a portion of $U_b$ determined by the value of $R_k$). The output voltage of the amplifier at 8 thus equals the desired overall voltage $U_g$.

Figure 3:
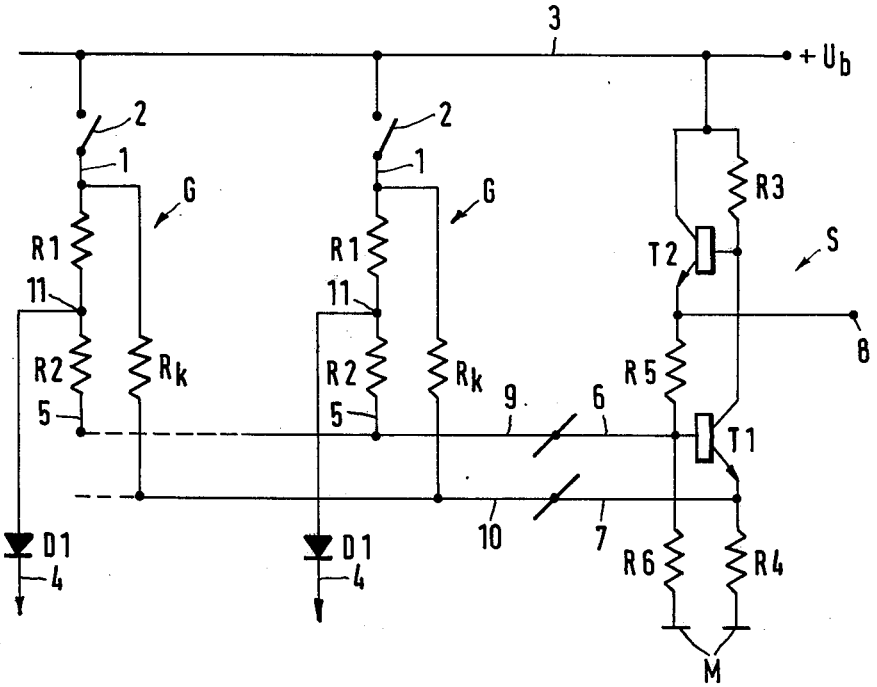
FIG. 3 is a circuit drawing of the schematic of FIG. 2.

FIG. 3 shows several gates G each of which comprises a diode $D_1$ and two resistors $R_1$ and $R_2$ having a common tap 11. The resistor $R_1$ is connected with the first input 1, the diode $D_1$ is connected with the second input 4, and the resistor $R_2$ is connected with the output 5 of the respective gate G.

The integrator S of FIG. 3 is a differential amplifier comprising a first transistor $T_1$ whose collector and emitter are respectively connected with resistors $R_3$ and $R_4$. The resistors $R_3$ and $R_4$ are connected in series between the supply conductor 3 and ground M (source of reference potential). A second transistor $T_2$ of the integrator S has a base which is connected to the collector of the transistor $T_1$, a collector which is connected with the conductor 3, i.e., with that end of the resistor $R_3$ which is remote from the collector of the transistor $T_1$, and an emitter which is connected with the output 8. The emitter of the transistor $T_2$ is further connected to the ground M or more accurately to a reference potential (i.e., that end of the resistor $R_4$ which is remote from the emitter of $T_1$) by means of two feedback resistors $R_5$ and $R_6$. The first input 6 of the circuit S is connected with the base of the transistor $T_1$ and with the tap between the feedback resistors $R_5$, $R_6$. The input 7 of the circuit S is connected with the emitter of the resistor $T_1$.

The inputs 4 of the gates G receive continuous sound signals of positive polarity. When a switch 2 is closed in response to depression of the associated key, a current flows to the sound generator through the resistor $R_1$ and diode $D_1$ and a second current flows to ground M through the resistors $R_1$, $R_2$ and $R_6$. Consequently, a tone frequency-dependent voltage is applied to the conductor 9 and hence to the input 6 (this voltage is analogous to the voltage signal $U_s$ of FIG. 1). At the same time, a current flows through the compensating resistor $R_k$ and the emitter resistor $R_4$. Therefore, a voltage which is proportional to the key voltage is applied to the input 7. If several gates are actuated simultaneously, the discrete currents are totalized in the resistors $R_6$ and $R_4$ so that the voltages at the inputs 6 and 7 rise accordingly.

Each voltage rise at the input 6 entails an increase of current flow through the collector-emitter circuit of the transistor $T_1$ and thus to a drop in collector voltage which is transmitted to the output 8 by way of the transistor $T_2$ which acts as an emitter-follower. Therefore, the input 6 is an inverting input. Each rise in voltage at the input 7 results in a reduction of current which flows through the collector-emitter circuit of the transistor $T_1$ and hence an increase in collector voltage. Thus, the input 7 is a noninverting input. The utilization of transistor $T_2$ results in an extremely low output resistance and, in combination with the feedback resistors $R_5$ and $R_6$, in an extremely low input resistance. The feedback branch further provides the starting voltage $U_a$ at the output 8, even when the key-actuated switches 2 are open, and such voltage $U_a$ is artificially reduced with respect to the supply voltage $U_b$ to such an extent that the AC component which is superimposed on the overall voltage $U_g$ does not result in a voltage exceeding the supply voltage $U_b$.

Figure 4:
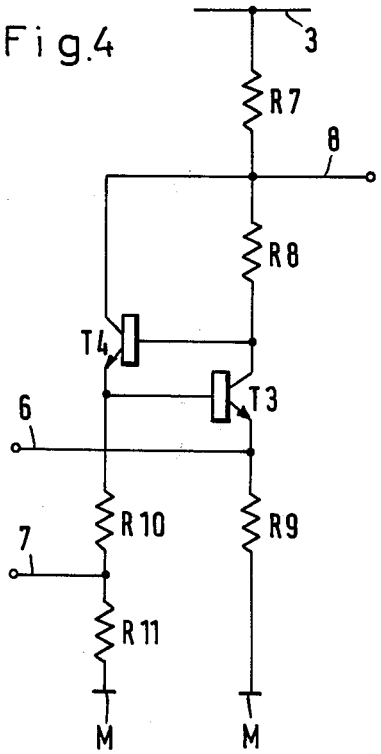
FIG. 4 is a circuit drawing of an integrator circuit utilized in the present invention.

In a successful practice, the circuit was constructed with components of the following values:

$U_b = +15$ V
$R_1 = +22$ K ohm
$R_2 = 100$ K ohm
$R_k = 100$ ohm
$R_3 = 22$ K ohm
$R_4 = 150$ ohm
$R_5 = 4.7$ ohm
$R_6 = 470$ ohm The embodiment of the differential amplifier which is shown in FIG. 4 comprises a first transistor $T_3$ whose base-emitter circuit is connected with a two-piece collector resistor $R_7$, $R_8$ and an emitter resistor $R_9$ in series between the conductor 3 and ground M. A second transistor $T_4$ has a base which is connected with the collector of the transistor $T_3$ and a collector which is connected to the tap between the components $R_7$ and $R_8$ of the collector resistor. The collector of the transistor $T_4$ is further connected to the output 8. The emitter of the transistor $T_4$ is connected with the base of the transistor $T_3$ and with ground M (by way of two feedback resistors $R_{10}$ and $R_{11}$). The first input 6 is connected with the emitter of the transistor $T_3$, and the second input 7 is connected with the tap between the feedback resistors $R_{10}$, $R_{11}$. In this circuit arrangement, the input 7 is an inverting input and the input 6 is noninverting. Here, too, the supply voltage $U_b$ at the conductor 3 exceeds by a predetermined value the voltage at the output 8.

Figure 5:
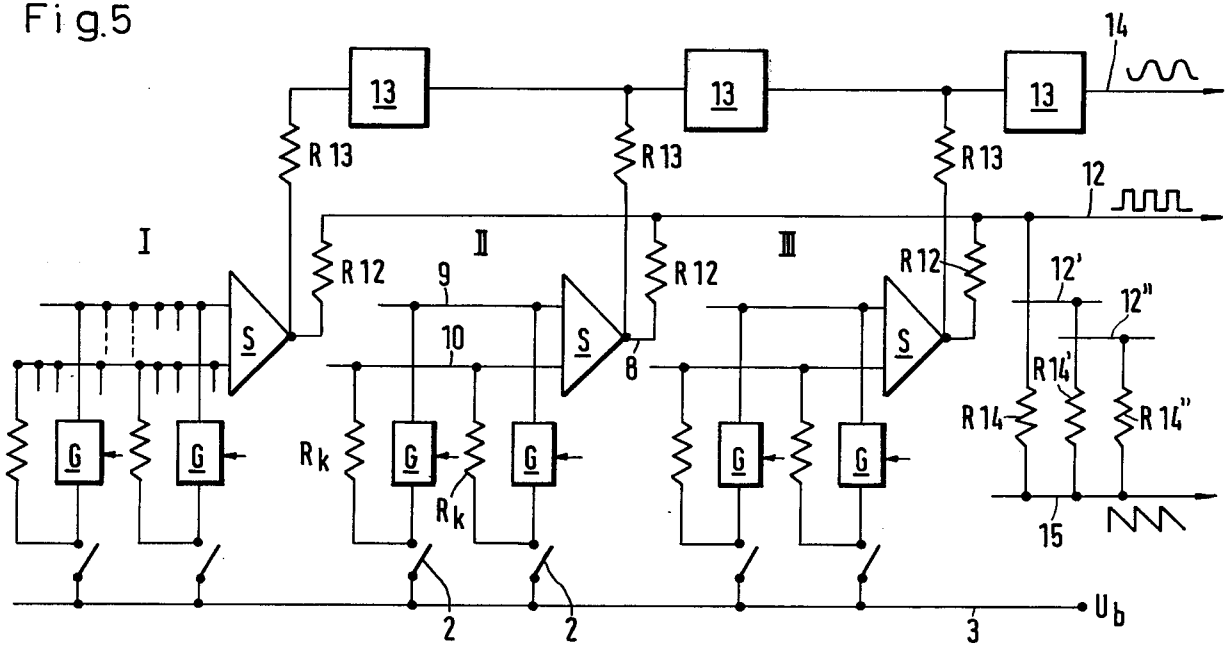
FIG. 5 depicts a circuit wherein several integrators, one for each of several groups of gates, are utilized in accordance with the present invention; and, FIG. 6 illustrates the connection between a gate and the tone generator of a musical instrument incorporating the present invention.

In the circuit arrangement of FIG. 5, the gates of groups of neighboring keys, (i.e., the keys of the octave) are grouped together and are connected to the inputs of discrete integrator circuits S. Thus, there develop several groups I, II, III, etc. The outputs of discrete integrator circuits S are connected with an output 12 for square signals by way of first decoupling resistors $R_{12}$. Such outputs are further connected with an output 14 for sinusoidal signals by way of second decoupling resistors 13 and sinusoidal filter stages 13. Several outputs 12, 12′, 12″ for square signals are connected with an output 15 for sawtooth signals by step-up resistors $R_{14}$, $R_{14}'$, $R_{14}''$. For example, a 16-foot sawtooth signal develops in that the square signal outputs for 16, 8, 4, 2 and 1 foot are connected with the output 15 by step-up resistors of double resistance, respectively. Since the output resistance of integrator circuits is low (e.g., 50 ohms), practically all cross talk between various outputs 12, 14 and 15 is eliminated. Furthermore, one achieves a highly accurate sine formation.

Figure 6:
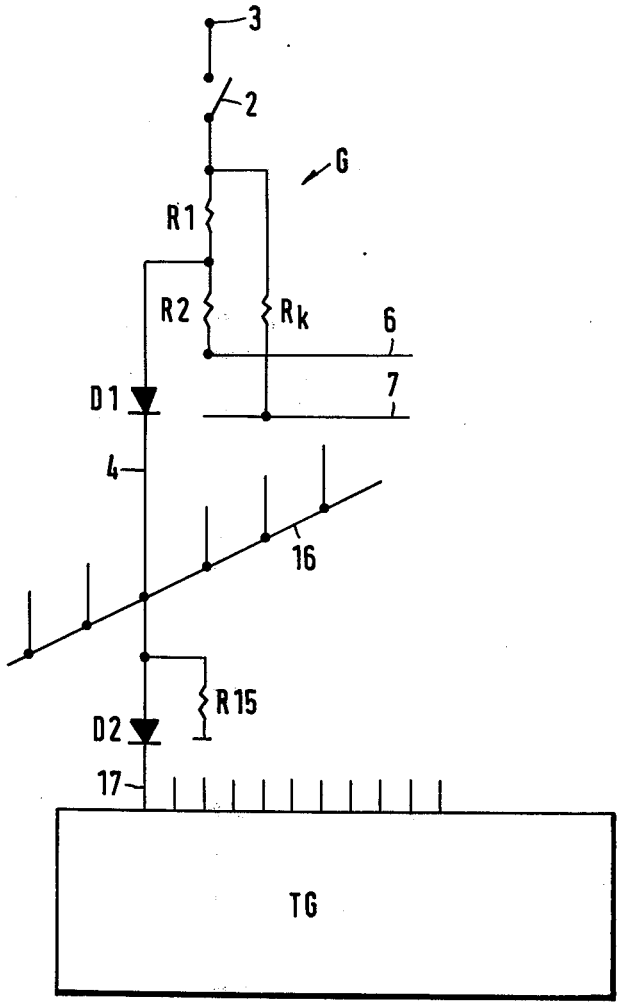

FIG. 6 shows the connection between a gate G and a tone generator TG. The input 4 is connected with a tone output 17 of the tone generator TG by way of a conventional system of cables 16 and a second diode $D_2$, and a conventional leakage resistance $R_{15}$ is also provided. This results in a signal to noise ratio of more than 100 dB. The number of second diodes $D_2$ is only a fraction of the number of first diodes $D_1$. Since the system of cables 16 conducts tone frequencies only when a corresponding key-operated switch is closed, the entire noise level of the tone frequency upon the sensitive input stages in the musical instrument is reduced considerably.

Thus, in accordance with the above, the aforementioned objects are attained.

What is claimed is:

1. In an electronic key-operated musical instrument, such as an organ, a combination comprising a gate circuit including a gate having a first input for a constant voltage actuated by depression of a key, a second input for a sound signal and an output connected to further processing stages within the instrument, and a compensating circuit for suppression of bounce, said compensating circuit including at least one combining circuit having a first input connected with the output of said gate, a second input and an output connected to said further processing stages, and a source of compensating voltage connected with said second input of said combining circuit, said compensating voltage being dependent on the constant voltage actuated by depression of a key.

2. The combination according to claim 1, wherein said gate comprises two resistors and a diode having a common connecting point with said resistors, one of said resistors being connected with the first input of said gate, said diode being connected with the second input of said gate and the other of said resistors being connected with the output of said gate, said source of compensating voltage including a compensating resistor connecting the second input of said combining circuit with the first of said gate.

3. The combination according to claim 1, wherein said combining circuit comprises a differential amplifier, one input of said combining circuit being an inverting (−) input and the other input of said being a noninverting (+) input.

4. The combination according to claim 3, wherein said differential amplifier comprises a transistor whose base and emitter are respectively connected with the first and second inputs of said combining circuit.

5. The combination according to claim 4, wherein said differential amplifier further comprises a feedback branch with a second transistor which insures that the voltage at the output of said combining circuit is less than said constant voltage, even in the absence of key voltage.

6. The combination according to claim 5, wherein said differential amplifier further comprises a collector resistor and an emitter resistor in series with the collector-emitter circuit of said first mentioned transistor, the base of said second transistor being connected with the collector of said first mentioned transistor, the collector of said second transistor being connected with that end of said collector resistor which is remote from the collector of said first mentioned transistor and the emitter of said second transistor being directly connected with the output of said combining circuit as well as with that end of said emitter resistor which is remote from the emitter of said first mentioned transistor, said differential amplifier further comprising two feedback resistors connected between the emitter of said second transistor and said emitter resistor and the first input of said combining circuit being connected with a tap between said feedback resistors.

7. The combination according to claim 5, wherein said differential amplifier further comprises a two-item collector resistor and an emitter resistor in series with the collector-emitter circuit of said first mentioned transistor, the base of said second transistor being connected with the collector of said first mentioned transistor, the collector of said second transistor being connected with a tap between the items of said collector resistor and with the output of said combining circuit and the emitter of said second transistor being connected with the base of said first mentioned transistor, said differential amplifier also comprising two feedback resistors connected between the emitter of said second transistor and that end of said emitter resistor which is remote from the emitter of said first mentioned transistor, the second input of said combining circuit being connected to a tap between said feedback resistors.

8. The combination according to claim 1, wherein said gate circuit comprises several gates connected to said combining circuit, said source of compensating voltage including a compensating resistor for each of said gates and said compensating resistors being connected between the first inputs of the respective gates and the second input of said combining circuit, said compensating circuit further comprising a source of reference potential and totalizing resistor means connecting said source of reference potential with the second input of said combining circuit.

9. The combination according to claim 8, wherein each of said gates further comprises a resistor connected with the output of the respective gate, said compensating circuit further comprising an input conductor connected with the outputs of said gates and with the first input of said combining circuit, a source of reference potential and totalizing resistor means connecting said source of reference potential with said input conductor, said compensating resistors being substantially equal in value to resistors which are connected with the outputs of the respective gates.

10. The combination according to claim 9, wherein the resistors which are connected to the outputs of said gates and the associated compensating resistors are stepped according to size.

11. The combination according to claim 10, wherein said combining circuit comprises two transistors, an emitter resistor connected with the emitter of one of said transistors and two feedback resistors connected with the emitter of the other of said transistors, said totalizing resistor means including said emitter resistor and one of said feedback resistors.

12. The combination according to claim 8, wherein said compensating circuit comprises a single combining circuit for all of said gates.

13. The combination according to claim 8, wherein said gates form part of a plurality of manuals and said compensating circuit comprises a discrete combining circuit for the gates of each of said manuals.

14. The combination according to claim 8, wherein said compensating circuit comprises a discrete combining circuit for the gates of each foot position of a manual.

15. The combination according to claim 8, wherein said compensating circuit comprises a discrete combining circuit for the gates of neighboring groups of keys of each foot position of each manual.

16. The combination according to clain 15, wherein the outputs of all combining circuits of a foot position are connected with a square signal output by way of first decoupling resistors and with a sine signal output by way of second decoupling resistors and sinusoidal filter stages, the square signal outputs of several foot positions being connected with a sawtooth output by way of stepped resistors.

17. The combination according to claim 1, wherein the key voltage is an envelope curve.

18. The combination according to claim 1, wherein said gate comprises a first diode connected with said second input of said gate and in series with at least one second diode.

19. The combination according to claim 1, wherein said gate circuit comprises several gates each including a diode connected with the second input of the respective gate, and further comprising a second diode connected with the diodes of a plurality of said gates.

* * * * *